United States Patent [19]

Wada et al.

[11] 4,257,828

[45] Mar. 24, 1981

[54] NON-AQUEOUS COMPOSITION FOR CHEMICAL TREATMENT OF A METALLIC SUBSTRATE

[75] Inventors: Hideo Wada; Akiro Ushio; Masaharu Koganei, all of Tokyo, Japan

[73] Assignee: Nippon Paint Co., Ltd., Japan

[21] Appl. No.: 113,267

[22] Filed: Jan. 18, 1980

[30] Foreign Application Priority Data

Jan. 19, 1979 [JP] Japan ..... 54-5151

[51] Int. Cl.[3] ..... C23F 7/10; C23F 7/26

[52] U.S. Cl. ..... 148/6.16; 148/6.2

[58] Field of Search ..... 148/6.16, 6.2, 6.15 R, 148/6.15 Z

[56] References Cited

U.S. PATENT DOCUMENTS

| | | | |
|---|---|---|---|
| 2,303,242 | 11/1942 | Tanner et al. | 148/6.16 |
| 2,857,298 | 10/1958 | Smith | 148/6.17 |
| 3,100,728 | 8/1963 | Vullo et al. | 148/6.15 R |
| 3,285,788 | 11/1966 | Svadlenak | 148/6.2 |

*Primary Examiner*—Ralph S. Kendall

*Attorney, Agent, or Firm*—Wenderoth, Lind & Ponack

[57] ABSTRACT

A non-aqueous composition for chemical treatment of the surface of a metallic substrate which comprises a chlorinated hydrocarbon solvent, chromic anhydride, phosphoric acid, a solubilizer and a stabilizer. By the use of such non-aqueous composition, chemical treatment can be achieved quickly with remarkable saving of operation steps. The coating resulting from such chemical treatment has a high corrosion resistance and an excellent adhesion with a paint coating film formed thereon.

9 Claims, No Drawings

NON-AQUEOUS COMPOSITION FOR CHEMICAL TREATMENT OF A METALLIC SUBSTRATE

The present invention relates to a non-aqueous composition for chemical treatment of a metallic substrate. More particularly, it relates to a non-aqueous composition for chemical teatment of the surface of a metallic substrate, which can be handled with ease and impart to the said surface a high corrosion resistance and a good adhesion with a coating film provided thereon.

There are known a number of aqueous compositions for chemical treatment of a metallic substrate. However, they have some certain drawbacks. In case of aqueous phosphating compositions, for instance, treatment of metallic substrates therewith cannot avoid byproduction of sludges. Further, their use requires additional steps including water rinsing. Furthermore, a step of drying, which requires a large quantity of energy, is needed prior to application of a coating composition. Moreover, the control of baths containing them is complicated, and a satisfactory chemical treatment is sometimes not achieved. In addition, the accidental stoppage of a continuous line for chemical treatment results in a production of rust on the metallic substrate due to the essential use of water therein. In case of aqueous chromating compositions, for instance, many steps for water rinsing are needed. Further, the waste water resulting from such water rinsing steps and containing a large amount of chromium ion causes a pollution problem. A particularly notable deficiency is that a sufficiently firm adhesion with a paint coating film provided on the treated surface is hardly assured.

In order to overcome the said drawbacks are seen in the cases using aqueous compositions, it has been proposed to accomplish chemical treatment by the use of a non-aqueous composition wherein a chlorinated hydrocarbon solvent (e.g. trichloroethylene, perchloroethylene, methylene chloride) is used as a liquid medium. This proposal is quite effective in suppressing the byproduction of sludges and reducing the number of steps. But, the performances of the coating resulting from such proposal have various defects. In case of phosphating, for instance, the produced coating is unduly thick and uneven. Since the reaction with the surface of the metallic substrate is insufficient, the coating is faint and sometimes sticky and does not firmly adhere onto such surface. Thus, the corrosion resistance and the adhesiveness with a paint coating film may be rather inferior to those in the case using an aqueous composition. In case of chromating, the resulting coating is also unduly thick and uneven, and the firm adhesion onto the surface of the metallic substrate is not assured. Further, the corrosion resistance and the adhesiveness with a paint coating film are much deteriorated in comparison with those in the case using an aqueous composition. In addition to the above defects, there is a common drawback arising from the use of a chlorinated hydrocarbon solvent as a liquid medium. Namely, the use of such liquid medium causes corrosion of the tank which accommodates the same as well as rusting of the metallic substrate by the decomposition products resulting therefrom.

According to the present invention, there is provided a non-aqueous composition for chemical treatment of the surface of a metallic substrate, which can form a non-sticky, uniform film firmly adhered to the said surface hardly produce sludges and impart a high corrosion resistance and a good adhesion with a paint coating film provided thereon to the said surface.

The term "non-aqueous" as hereinabove is not intended to absolutely exclude the presence of any amount of water but to exclude the presence of a substantial or considerable amount of water. In other words, the presence of water in such a small amount is insufficient to serve as a liquid medium only by itself is permissible.

The non-aqueous composition of this invention comprises a chlorinated hydrocarbon solvent, chromic anhydride, phosphoric acid, a solubilizer and a stabilizer.

As the chlorinated hydrocarbon solvent, there may be used those having 1 or 2 carbon atoms such as perchloroethylene, trichloroethylene, 1,1,1- or 1,1,2-trichloroethane, methylene chloride, chloroform, carbon tetrachloride, 1,1,1,2- or 1,1,2,2-tetrachloroethane, pentachloroethane and hexachloroethane. The term "chlorinated hydrocarbon" covers any chlorinated and fluorinated hydrocarbon. Thus, those which corresond to the above exemplified chlorinated hydrocarbons and wherein at least one of hydrogen atoms and chlorine atoms (but always retaining at least one chlorine atom) is replaced by a fluorine atom are also usable. Examples of fluorinated ones are those having 1 or 2 carbon atoms such as 1,1,2-trichloro-1,2,2-trifluoroethane and trichlorofluoromethane. Among specific chlorinated (and fluorinated) hydrocarbons, particularly preferred are methylene chloride and 1,1,2-trichloro-1,2,2-trifluoroethane. Still, the said chlorinated hydrocarbons may be used alone or in combination. Since the chlorinated hydrocarbon solvent is generally non-inflammable, the resulting non-aqueous composition is hardly inflammable and can be used safely in industry.

The chromic anhydride is alternatively called "chromium trioxide" ($CrO_3$). It may be used in an amount of 0.003 to 0.03 part by weight to 100 parts by weight of the chlorinated hydrocarbon solvent. When the amount is smaller than the lower limit, the corrosion resistance as well as the adhesion with a paint coating film is inferior. When the amount is larger than the upper limit, the adhesion with a paint coating film is lowered.

As the phosphoric acid, there may be used orthophosphoric acid, pyrophosphoric acid, triphosphoric acid, trimetaphosphoric acid, tetrametaphosphoric acid or the like. Among them, the use of orthophosphoric acid is particularly favorable. Commercially available aqueous phosphoric acid wherein the phosphoric acid concentration is 75% or higher may be as such used effectively. The amount of phosphoric acid to be used may be from 0.003 to 0.12 part by weight to 100 parts by weight of the chlorinated hydrocarbon solvent. When the amount is smaller than the lower limit, the corrosion resistance and the adhesion with a paint coating film are inferior. When the amount is larger than the upper limit, the adhesion with a paint coating film is somewhat poor.

The solubilizer is required to be one which is per se soluble in the chlorinated hydrocarbon solvent and can solubilize chromic anhydride and phosphoric acid therein. Specific examples of the solubilizer are monovalent saturated alcohols having 1 to 7 carbon atoms such as sec-propanol, t-butanol and t-pentanol. These may be used alone or in combination. The amount of the solubilizer may be that which can solubilize the designed amounts of chromic anhydride and of phosphoric acid into the chlorinated hydrocarbon solvent and is usually from 0.1 to 2 parts by weight to 100 parts by weight of the chlorinated hydrocarbon solvent. When the amount is smaller than the lower limit, the solubilizing effect may be insufficient. When larger than the upper limit, the inflammability of the resulting non-aqueous composition is unfavorably increased.

As the stabilizer, there is used one which can contribute to prevention of the decomposition of the chlorinated hydrocarbon solvent, inhibition of the reduction of chromic anhydride and/or stabilization of the resulting non-aqueous composition. Examples of the stabilizer are organic acis (e.g. glacial acetic acid), nitroso, nitro, azo or azoxy aromatic compounds (e.g. 5-nitroso-8-quinolinol, 5-nitroso-2-aminoanisole, p-nitrodimethylaniline, 1-nitroso-2-naphthol, N-nitrosodiphenylamine, p-nitrophenol, azobenzene, azoxybenzene, 3,3-dinitroazoxybenzene, 1-o-nitrophenylazonaphthylamine, 2,4-dinitrotoluene), quinones (e.g. hydroquinone, parabenzoquinone), thiourea, organic nitrites (e.g. dicyclohexylammonium nitrite, amyl nitrite), trialkyl phosphites (e.g. tributyl phosphite, trihexyl phosphite, tris(2-ethylhexyl)phosphite, tridecyl phosphite), tri-(substituted or unsubstituted)phenyl phosphites (e.g. triphenyl phosphite, tris(p-methylphenyl)phosphite), organic amines (e.g. diisobutylamine, diisopropylamine), eugenols (e.g. eugenol, isoeugenol), aromatic glycidyl ethers (e.g. glycidyl phenyl ether), dienes (e.g. pentadiene, isoprene, chloroprene), dimethoxyalkanes (e.g. dimethoxymethane, 1,1-dimethoxyethene, dimethyl carbonate), methanol, cyclic ethers (e.g. 1,3-dioxane, 1,4-dioxane), zinc oxide, zinc fluoride, etc. Particularly preferred stabilizers are the combination of zinc fluoride and parabenzoquinone, the combination of zinc oxide and 1-nitroso-2-naphthol, the combination of a trialkyl phosphite and methanol, the combination of eugenol and diisobutylamine, the combination of dimethoxyethane and isoprene, etc. The amount of the stabilizer may be from 0.001 to 5 parts by weight to 100 parts by weight of the chlorinated hydrocarbon solvent. When it is smaller than the lower limit, the stabilizing effect may be insufficient. When it is larger than the upper limit, the inflammability of the resulting non-aqueous composition will be increased.

The non-aqueous composition of this invention may be prepared by mixing the above components in an optional order to make uniform. When desired, various surface active agents and resins may be incorporated into the mixture. By the use of surface active agents, degreasing, which can prevent a certain degree of contamination during the chemical treatment, is realized, so that the two steps of degreasing and of chemical treating can be combined as one step. As such surface active agents, nonionic ones may be employed. By the use of resins, an undercoating effect for subsequent paint coating can be expected, and the two steps of chemical treating and of undercoating can be combined as one step. Examples of such resins are polyester resins, amino resins, epoxy resins, polyurethane resins, acrylic resins, vinyl resins, etc.

The non-aqueous composition of the invention may be applied to the surface of various kinds of metallic substances (e.g. iron, zinc and zinc alloy, aluminum and aluminum alloy, tin, etc.). Its application onto a tin-plated iron or steel such as a draw and ironing-processed, tin-plated steel can produce particular advantages.

The chemical treatment with the non-aqueous composition of the invention may be effected by contacting the surface of a metallic substrate previously subjected or not to degreasing for elimination of oil, grease, dust and stain with the said non-aqueous composition at a temperature from room temperature to the boiling point of the non-aqueous composition, usually for about 1 to 5 seconds. Then, the liquid component on the surface is eliminated by evaporation. Since the non-aqueous composition has a low boiling point, a low specific heat and a low evaporation latent heat, no special apparatus is needed for drying; but if necessary, drying treatment may be effected by the use of warm air or hot air of about 150° C. for several seconds, insofar as any unfavorable influence is not exerted upon the production steps.

The metal treated with the non-aqueous composition of the invention shows, as such, a good corrosion-resistance without further paint coating. By effecting paint coating thereon, the corrosion-resistance is more enhanced, and the metal surface becomes bearable against subsequent severe processing operations, owing to good paint-adhesion.

When the non-aqueous composition of the invention is used, water rinsing after the chemical treatment is not required so that waste water treatment is unnecessary. In case of effecting the degreasing step, a chlorinated hydrocarbon solvent may be employed so as to omit water rinsing after degreasing, which increases the usefulness of the non-aqueous composition of the invention.

The omission of water rinsing decreases the number of operational steps in the treatment. By such shortening of treatment steps and the above mentioned omission of waste water treatment, the space required for installation of the apparatus for the use of the non-aqueous composition of the invention can be greatly reduced in comparison with the combination of a convention apparatus for metal surface treatment by the use of an aqueous composition and a conventional apparatus for waste water treatment.

Owing to the use of the chlorinated hydrocarbon solvent, the heat energy amount required at the stages of chemical treatment and of drying is small. By recovering the chlorinated hydrocarbon solvent once evaporated, air pollution can be prevented, and the recovered solvent can be reused, which contributes to saving of resources.

The non-aqueous composition of the invention may be applied to the surface of metals by a simple operation, and the treating time is extremely short, i.e. within several seconds. Thus, by the use of such non-aqueous composition simplification and shortening of the chemical treatment can be attained.

The present invention will be hereinafter explained further in detail by the following Examples and Comparative Examples, wherein parts and % are by weight.

EXAMPLES 1 TO 5

Non-aqueous compositions for chemical treatment were prepared according to the prescriptions as shown in Table 1.

TABLE 1

| | Example | | | | |
|---|---|---|---|---|---|
| Materials (part(s)) | 1 | 2 | 3 | 4 | 5 |
| Trichloroethylene | 100 | 100 | 100 | 100 | 100 |
| Chromic anhydride | 0.015 | 0.001 | 0.015 | 0.015 | 0.015 |
| 75% Orthophosphoric acid | 0.06 | 0.06 | 0.2 | 0.06 | 0.06 |
| t-Pentanol | 0.5 | 0.5 | 0.5 | 0.5 | 0.5 |
| Parabenzoquinone | 1 | 1 | 1 | 0 | 1 |

TABLE 1-continued

| Materials (part(s)) | Example 1 | 2 | 3 | 4 | 5 |
|---|---|---|---|---|---|
| Zinc fluoride | 0.005 | 0.005 | 0.005 | 0.005 | 0 |

A clean steel plate (150×70×0.8 mm) previously degreased with trichloroethylene vapor was immersed in the non-aqueous composition heated at 84° C. for 1 second. Then, the plate was taken out and dried in the air. On the thus treated steel plate, an acrylic resin paint composition ("Super Lac D-4TX-64 Enamel" manufactured by Nippon Paint Co., Ltd.) was applied by spraying to make a dry film thickness of 30 microns and baked in a furnace of 160° C. for 20 minutes to obtain a coated plate, of which the performance is shown in Table 2.

COMPARATIVE EXAMPLE 1

A weak alkali cleaner ("Ridoline 75 N-1" manufactured by Nippon Paint Co., Ltd.) was dissolved in tap water to make a concentration of 2%, and the resultant solution was warmed to 60° C. Using the thus prepared degreasing solution, a steel plate having the same size as in Examples 1 to 5 was degreased by spraying for 2 minutes and then washed with water.

A solution of a zinc phosphate chemical ("Granodine 164" manufactured by Nippon Paint Co., Ltd.) (2 parts), 20% sodium hydroxide solution (0.4 part) and 20% sodium nitrite solution (0.1 part) in tap water (100 parts) was warmed to 45° C. and sprayed onto the above cleaned steel plate for 2 minutes to make a phosphate coating of 2.3 g/m$^2$. The thus treated plate was subjected to paint coating as in Examples 1 to 5 to obtain a coated plate, of which the performance is shown in Table 2.

TABLE 2

| Test item | | Example 1 | 2 | 3 | 4 | 5 | Comparative Example 1 |
|---|---|---|---|---|---|---|---|
| Impact strength *1 | 30 cm | 0 | 0 | 0 | 0 | 0 | 0 |
| | 50 cm | 0 | Δ | 0 | Δ | 0 | Δ |
| Resistance against salt spray*2 | 240 hrs | 0 | 0 | 0 | Δ | Δ | 0 |
| | 500 hrs | 0 | Δ | Δ | x | x | Δ |
| Acid resistance *3 | | 0 | Δ | Δ | Δ | Δ | Δ |

Note: *1Du Pont impact tester, ½ inch R, 500 g, 30cm, 50 cm.
o: Paint film not peeled off.
Δ: Paint film partially peeled off.
x: 50% or more of paint film peeled off.
*2Salt spray tester, 5% aqueous sodium chloride solution, 35° C. cross-cut on paint film, 240 hours, 500 hours.
o: Swelling of paint film observed within 1 mm from cross-cut line.
Δ: Swelling of paint film observed within 3 mm from cross-cut line.
x: Swelling of paint film observed beyond 3 mm from cross-cut line.
*3Immersion into 5% acetic acid, 20° C. 72 hours, peeling-off of cross-cut by tape.
o: Paint film peeled off in 2% or less.
Δ: Paint film peeled off in 2 to 20%.
x: Paint film peeled off in 20% or more.

EXAMPLES 6 AND 7

Non-aqueous compositions for chemical treatment were prepared according to the prescriptions as shown in Table 3.

TABLE 3

| Materials (part(s)) | Example 6 | 7 |
|---|---|---|
| 1,1,1-Trichloroethane | 100 | 100 |
| Chromic anhydride | 0.001 | 0.005 |
| 75% Orthophosphoric acid | 0.01 | 0.02 |

TABLE 3-continued

| Materials (part(s)) | Example 6 | 7 |
|---|---|---|
| t-Butanol | 0.3 | 0.3 |
| 1-Nitroso-2-naphthol | 1 | 1 |
| Zinc oxide | 0.005 | 0.005 |

A tin-plated steel plate (100×70×0.25 mm) formerly draw and ironing-processed was degreased as in Examples 1 to 5 and immersed in the non-aqueous composition heated at 72° C. for 2 seconds. Then, the plate was taken out and dried in a drier at 80° C. for 5 minutes. On the thus treated plate, an epoxy resin clear paint was applied by spraying to make a dry film thickness of 4 microns and baked in a furnace of 200° C. for 5 minutes to obtain a coated plate, of which the performance is shown in Table 4.

COMPARATIVE EXAMPLE 2

The same weak alkali cleaner as in Comparative Example 1 was dissolved in tap water to make a concentration of 1%, and the resultant solution was warmed to 60° C. Using the thus prepared degreasing solution, the same tin-plated steel plate as in Examples 6 and 7 was degreased by spraying for 1 minute and then washed with water.

A solution of a phosphoric-chromate treatment chemical ("Alodine 401" manufactured by Nippon Paint Co., Ltd.) (1.2 parts) in tap water (100 parts) was warmed to 40° C. and sprayed onto the above cleaned tin-plated steel plate for 30 seconds. Then, the plate was washed with water and dried (150° C.×3 minutes). The thus treated plate was subjected to paint coating as in Examples 6 and 7 to obtain a coated plate, of which the performances are shown in Table 4.

TABLE 4

| Test item | Example 6 | 7 | Comparative Example 2 |
|---|---|---|---|
| Ferro test *1 | o | o | Δ |
| Boiling water resistance *2 | o | o | o |
| Acid resistance *3 | o | o | x |

Note:
*1Test for tin-plated steel plate before paint coating.
Test solution: obtained by dissolving a surface active agent "FC-126" (ammonium perfluorocaprylate; manufactured by Sumitomo 3M Co., Ltd.) (0.1 part), sodium chloride (4 parts) and potassium ferricyanide (3 parts) in pure water (100 parts), allowing to stand in a dark place for 24 hours and filtering through a filter paper (Toyo filter Paper No. 22).
Test procedure: immersing a filter paper (Toyo Filter Paper No. 52, 50 × 22 mm) into the test solution, eliminating the excess amount of the test solution by contacting the filter paper with the brim of a bottle, placing the filter paper on a test plate, peeling off the filter paper after 2 minutes and subjecting it to water washing and drying.
o: Blue color hardly observed on the filter paper.
Δ: About 6 to 20 spots of blue color observed on the filter paper.
x: More than 20 spots of blue color observed on the filter paper; the whole surface turned blue.
*2Tap water, 98–100° C., 1 hour, peeling-off of cross-cut by tape.
o: Paint film peeled off in 2% or less.
ΔPaint film peeled off in 2 to 20%.
x: Paint film peeled off in 20% or more.
*3Immersion of 5% acetic acid, 98–100° C., 1 hour, peeling off of cross-cut tape.
o: Paint film peeled off in 2% or less.
Δ: Paint film peeled off in 2 to 20%.
x: Paint film peeled off in 20% or more.

EXAMPLES 8 to 12

Non-aqueous compositions for chemical treatment were prepared according to the prescriptions as shown in Table 5.

TABLE 5

| Materials (part(s)) | Example 8 | 9 | 10 | 11 | 12 |
|---|---|---|---|---|---|
| Methylene chloride | 100 | 100 | 100 | 100 | 100 |
| Chromic anhydride | 0.015 | 0.001 | 0.06 | 0.015 | 0.015 |
| 75% Orthophosphoric acid | 0.06 | 0.06 | 0.06 | 0.001 | 0.3 |
| t-Butanol | 0.5 | 0.5 | 0.5 | 0.5 | 0.5 |
| Trialkylphosphite | 1 | 1 | 1 | 1 | 1 |
| Methanol | 0.5 | 0.5 | 0.5 | 0.5 | 0.5 |

A clean steel plate (150×70×0.8 mm) previously degreased with methylene chloride vapor was immersed in the non-aqueous composition heated at 40° C. for 1 second. Then, the plate was taken out and dried in the air. On the thus treated steel plate, an acrylic resin paint composition ("Super Lac D-4TX-64 Enamel" manufactured by Nippon Paint Co., Ltd.) was applied by spraying to make a dry film thickness of 30 microns and baked in a furnace of 160° C. for 20 minutes to obtain a coated plate, of which the performance is shown in Table 6.

TABLE 6

| Test item | | Example 8 | 9 | 10 | 11 | 12 |
|---|---|---|---|---|---|---|
| Impact strength*1 | 30 cm | o | o | o | o | Δ |
| | 50 cm | o | Δ | Δ | Δ | x |
| Resistance against salt spray*2 | 240 hrs | o | o | o | o | o |
| | 500 hrs | o | Δ | o | Δ | Δ |
| Acid resistance*3 | | o | Δ | o | o | o |

Note:
*1, 2 & 3 same as those under Table 2.

EXAMPLES 13 to 17

Non-aqueous compositions for chemical treatment were prepared according to the prescriptions as shown in Table 7.

TABLE 7

| Materials (part(s)) | Example 13 | 14 | 15 | 16 | 17 |
|---|---|---|---|---|---|
| Methylene chloride | 100 | 100 | 100 | 100 | 100 |
| Chromic anhydride | 0.015 | 0.001 | 0.06 | 0.015 | 0.015 |
| 75% Orthophosphoric acid | 0.06 | 0.06 | 0.2 | 0.006 | 0.06 |
| t-Butanol | 0.5 | 0.5 | 0.5 | 0.5 | 0.5 |
| Parabenzoquinone | 1 | 1 | 1 | 0 | 1 |
| Zinc fluoride | 0.005 | 0.005 | 0.005 | 0.005 | 0 |

A clean steel plate (150×70×0.8 mm) previously degreased with methylene chloride vapor was immersed in the non-aqueous composition heated at 40° C. for 1 second. Then, the plate was taken out and dried in the air. On the thus treated steel plate, an acrylic resin paint composition ("Super Lac D-4-TX-64 Enamel" manufactured by Nippon Paint Co., Ltc.) was applied by spraying to make a dry film thickness of 30 microns and baked in a furnace of 160° C. for 20 minutes to obtain a coated plate, of which the performances are shown in Table 9.

COMPARATIVE EXAMPLES 3 AND 4

Non-aqueous compositions for chemical treatment were prepared according to the prescriptions as shown in Table 8.

TABLE 8

| Materials (part(s)) | Comparative Example 3 | 4 |
|---|---|---|
| Trichloroethylene | 100 | 100 |
| 75% Orthophosphoric acid | 0.5 | — |
| Chromic anhydride | — | 0.35 |
| Primary butanol | 5 | — |
| Tertiary butanol | — | 5 |
| Parabenzoquinone | 1 | — |
| Zinc fluoride | — | 0.005 |

A clean steel plate (150×70×0.8 mm) previously degreased with trichloroethylene vapor was immersed in the non-aqueous composition heated at 84° C. for 1 minute, taken out from the non-aqueous composition and dried in an oven at 200° C. for 2 minutes (Comparative Example 3). Alternatively, the clean steel plate as degreased above was immersed in the non-aqueous composition heated at 60° C. for 10 seconds, taken out from the non-aqueous composition and dried in an oven at 200° C. for 2 minutes (Comparative Example 4). The thus treated steel plate was subjected to paint coating as in Examples 13 to 17 to obtain a coated plate, of which the performance is shown in Table 9.

COMPARATIVE EXAMPLE 5

A weal alkali cleaner ("Ridoline 75 N-1" manufactured by Nippon Paint Co., Ltd.) was dissolved in tap water to make a concentration of 2%, and the resultant solution was warmed to 60° C. Using the thus prepared degreasing solution, a steel plate having the same size as in Examples 13 to 17 was degreased by spraying for 2 minutes and then washed with water.

A solution of a zinc phosphate chemical ("Granodine 164" manufactured by Nippon Paint Co., Ltd.) (2 parts), 20% sodium hydroxide solution (0.4 part) and 20% sodium nitrite solution (0.1 part) in tap water (100 parts) was warmed to 45° C. and sprayed onto the above cleaned steel plate for 2 minutes to make a phosphate coating of 2.3 g/m$^2$. The thus treated plate was subjected to paint coating as in Examples 13 to 17 to obtain a coated plate, of which the performance is shown in Table 9.

TABLE 9

| Test item | | Example 13 | 14 | 15 | 16 | 17 | Comparative Example 3 | 4 | 5 |
|---|---|---|---|---|---|---|---|---|---|
| Impact strength*1 | 30 cm | o | o | o | o | o | Δ | Δ | o |
| | 50 cm | o | Δ | Δ | Δ | o | x | x | Δ |
| Resistance against salt spray*2 | 240 hrs | o | o | o | Δ | Δ | Δ | o | o |
| | 500 hrs | o | Δ | o | x | x | x | Δ | Δ |
| Acid resistance*3 | | o | o | Δ | Δ | Δ | X | Δ | Δ |

Note:
*1, 2 & 3 same as those under Table 2.

EXAMPLES 18 to 21

Non-aqueous compositions for chemical treatment were prepared according to the prescriptions as shown in Table 10.

TABLE 10

| materials (Part(s)) | Example 18 | 19 | 20 | 21 |
|---|---|---|---|---|
| Methylene chloride | 100 | 100 | 100 | 100 |
| Chromic anhydride | 0.01 | 0.005 | 0.005 | 0.003 |
| 75% Orthophosphoric | 0.01 | 0.02 | 0.02 | 0.01 |

TABLE 10-continued

| materials (Part(s)) | Example 18 | 19 | 20 | 21 |
|---|---|---|---|---|
| acid | | | | |
| t-Butanol | 0.3 | 0.3 | 0.3 | 0.3 |
| Trialkyl phosphite | 1 | 1 | — | — |
| Methanol | 0.5 | 0.5 | — | — |
| Eugenol | — | — | 0.1 | — |
| Diisobutylamine | — | — | 0.1 | — |
| Dimethoxyethane | — | — | — | 0.03 |
| Isoprene | — | — | — | 0.01 |

A tin-plated steel plate (100×70×0.25 mm) formerly draw and ironing-processed was degreased as in Examples 13 to 17 and immersed in the non-aqueous composition heated at 40° C. for 2 seconds. Then, the plate was taken out and dried in a drier at 80° C. for 5 minutes. On the thus treated plate, an epoxy resin clear paint was applied by spraying to make a dry film thickness of 4 microns and baked in a furnace of 200° C. for 5 minutes to obtain a coated plate, of which the performance is shown in Table 11.

COMPARATIVE EXAMPLES 6 AND 7

As in Examples 18 to 21, chemical treatment and subsequent paint coating were carried out but using the non-aqueous compositions as in Comparative Examples 3 and 4 (Table 8) to obtain a coated plate, of which the performance is shown in Table 11.

COMPARATIVE EXAMPLE 8

The same weak alkali cleaner as in Comparative Example 5 was dissolved in tap water to make a concentration of 1%, and the resultant solution was warmed to 60° C. Using the thus prepared degreasing solution, the same tin-plated steel plate as in Examples 18 to 21 was degreased by spraying for 1 minute and then washed with water.

A solution of a phosphoric-chromate treatment chemical ("Alodine 401" manufactured by Nippon Paint Co., Ltd.) (1.2 parts) in tap water (100 parts) was warmed to 40° C. and sprayed onto the above cleaned tin-plated steel plate for 30 seconds. Then, the plate was washed with water and dried (150° C.×3 minutes). The thus treated plate was subjected to paint coating as in Examples 18 to 21 to obtain a coated plate, of which the performance is shown in Table 11.

TABLE 11

| Test item | Example 18 | 19 | 20 | 21 | Comparative Example 6 | 7 | 8 |
|---|---|---|---|---|---|---|---|
| Ferro test*1 | o | o | o | o | x | Δ | Δ |
| Boiling water resistance*2 | o | o | o | o | Δ | o | o |
| Acid resistance*3 | o | o | o | o | x | Δ | x |

Note:
*1, 2 & 3 same as those under Table 4.

What is claimed is:

1. A substantially non-aqueous composition for chemical treatment of the surface of a metallic substrate, which comprises a chlorinated hydrocarbon solvent, chromic anhydride, phosphoric acid, a solubilizer which is per se soluble in the chlorinated hydrocarbon solvent, can solubilize the chromic anhydride and the phosphoric acid therein and a stabilizer which can prevent the decomposition of the chlorinated hydrocarbon solvent, inhibition of the reduction of the chromic anhydride or stabilization of the non-aqueous composition, and wherein the weight proportion of the chlorinated hydrocarbon solvent, chromic anhydride, phosphoric acid, the solubilizer and the stabilizer is 100:0.003–0.03:0.003–0.12:0.1–2:0.001–5.

2. The composition according to claim 1, wherein the chlorinated hydrocarbon is methylene chloride or 1,1,2-trichloro-1,2,2-trifluoroethane.

3. The composition according to claim 1, wherein the phosphoric acid is orthophosphoric acid.

4. The composition according to claim 1, wherein the solubilizer is a monovalent saturated alcohol having 1 to 7 carbon atoms which is per se soluble in the chlorinated hydrocarbon solvent and can solubilize chromic anhydride and phosphoric acid therein.

5. The composition according to claim 4, wherein the solubilizer is sec-propanol, t-butanol or t-pentanol.

6. The composition according to claim 1, wherein the stabilizer is at least one of organic acids, nitroso, nitro, azo or azoxy aromatic compounds, quinones, thiourea, organic nitrites, organic phosphites, organic amines, eugenols, aromatic glycidyl ethers, dienes, dimethoxyalkanes, methanol, cyclic ethers, zinc oxide and zinc fluoride.

7. The composition according to claim 1, wherein the chlorinated hydrocarbon solvent is methylene chloride or 1,1,2-trichloro-1,2,2-trifluoroethane, the phosphoric acid is orthophosphoric acid and the solubilizer is t-butanol.

8. A method for chemical treatment of the surface of a metallic substrate, which comprises treating the said surface with the non-aqueous composition according to claim 1 to impart to the said surface a high corrosion resistance and an excellent adhesion with a paint coating film provided thereon.

9. The method according to claim 8, wherein the said surface is that of a draw and ironing-processed, tin-plated iron or steel can.

* * * * *